US005525093A

United States Patent [19]

Palmer, Jr.

[11] Patent Number: 5,525,093

[45] Date of Patent: Jun. 11, 1996

[54] CLEANING METHOD AND APPARATUS

[75] Inventor: Charles E. Palmer, Jr., Plum Boro, Pa.

[73] Assignee: Westinghouse Electric Corporation, Pittsburgh, Pa.

[21] Appl. No.: 54,491

[22] Filed: Apr. 27, 1993

[51] Int. Cl.[6] ..... B24B 1/00

[52] U.S. Cl. ..... 451/40; 451/39; 451/91; 451/90; 134/7

[58] Field of Search ..... 51/427, 429, 319, 51/320, 321, 322; 134/7; 451/38, 39, 40, 53, 90, 91, 92

[56] References Cited

U.S. PATENT DOCUMENTS

| | | | |
|---|---|---|---|
| 4,038,786 | 8/1977 | Fong | 51/320 |
| 4,389,820 | 6/1983 | Fong et al. | 51/410 |
| 4,617,064 | 10/1986 | Moore | 134/7 |
| 4,707,951 | 11/1987 | Gibot et al. | 51/410 |
| 4,727,687 | 3/1988 | Moore | 51/410 |
| 4,744,181 | 5/1988 | Moore et al. | 51/436 |
| 4,947,592 | 8/1990 | Lloyd et al. | 51/436 |
| 4,977,910 | 12/1990 | Miyahara et al. | 135/7 |
| 5,062,898 | 11/1991 | McDermott et al. | 134/7 |
| 5,074,083 | 12/1991 | Kanno et al. | 51/410 |
| 5,109,636 | 5/1992 | Lloyd et al. | 51/320 |
| 5,123,207 | 6/1992 | Gillis, Jr. et al. | 51/426 |

*Primary Examiner*—Bruce M. Kisliuk
*Assistant Examiner*—Eileen P. Morgan

[57] ABSTRACT

Disclosed is a method and apparatus for the blast cleaning of the surface of an object using solid carbon dioxide pellets as the abrasive projected by a gaseous carbon dioxide propellent. The method and apparatus of this invention subjects a portion of a quantity of liquified carbon dioxide contained within a storage vessel to adiabatic expansion to provide a solid phase carbon dioxide and then compressing or extruding the solid phase carbon dioxide to form a plurality of pellets. Another portion of the liquified carbon dioxide is vaporized to provide a volume of gaseous carbon dioxide at above atmospheric pressure which is then used as a carrier and propellent to project the carbon dioxide pellets against the surface of the object to be cleaned. This invention eliminates the need to use a separate compressed air or nitrogen propellent system for a blast cleaning operation.

5 Claims, 1 Drawing Sheet

CLEANING METHOD AND APPARATUS

BACKGROUND OF THE INVENTION

This invention relates to a method and apparatus for cleaning the surface of objects using a blast of particles. Particle blast cleaning is well known in the art. The most common form of particle blast cleaning is sandblasting in which fine abrasive particles of sand or other grit are propelled by a jet of high pressure air against the surface of the object to be cleaned. Another form of particle blast cleaning uses small particles or pellets of solidified carbon dioxide as the abrasive which is propelled by a jet of high pressure air or nitrogen against the surface of the object to be cleaned. Carbon dioxide particles or pellets have the advantage over sand or grit in that the carbon dioxide particles or pellets will not work harden the surface of the object being cleaned and will sublimate after they strike the surface to be cleaned. Therefore, solid carbon dioxide particles and pellets are environmentally cleaner and safer to use and save the labor and expense usually needed to clean up the spent sand or grit used in sandblasting.

The solid carbon dioxide abrasives used for blast cleaning are usually small solid carbon dioxide pellets produced by compressing solid phase carbon dioxide snow in a pelletizer or compressing and extruding solid phase carbon dioxide snow in an extruder, such as described in U.S. Pat. No. 4,727,687 to Moore. The known carbon dioxide blast cleaning equipment has usually used compressed air as the propellent to project the pellets against the surface to be cleaned because of the low cost and availability of compressed air in many fabrication shops and locations. In some cases nitrogen has also been used as the propellent.

Blast cleaning systems that use compressed air as the propellent require large compressors, dryers and filters to achieve sufficient compressed air pressures and volumes and to remove moisture and contaminants, such as oil, from the compressed air. The compressors, dryers and filters must be sized to supply sufficient air for maximum cleaning operations which usually dictates that very large compressors, dryers and filters must be used. If the cleaning is to be performed in the field rather than a shop, the compressors, dryers, filters and other auxiliary equipment must be mounted on a mobile carrier, such as a tractor-trailer, with a driver and compressor operator required to operate and maintain the air compressor facilities.

For some field blast cleaning operations, high pressure nitrogen contained in steel cylinders has been used as the propellent to avoid the necessity for the large and expensive air compressors and dryers, but this approach has been not only quite expensive because of the cost of nitrogen but also requires a plurality of large nitrogen cylinder trailers at the cleaning site to provide a continuous and sufficient supply of propellent. The use of compressed air also introduced the possibility of contaminants, such as oil or other foreign materials, to enter the system and end up contaminating the surface being cleaned and the blast cleaning equipment itself.

SUMMARY OF THE INVENTION

It is therefore an objective of this invention to provide a method and apparatus for carbon dioxide pellet blast cleaning that will eliminate the air compressors, dryers and filters usually required for such blast cleaning operations.

It is further an objective of this invention to provide a method and apparatus for carbon dioxide pellet blast cleaning that reduces the manpower requirements, equipment expense and maintenance and space required for blast cleaning operations.

It is a still further objective of this invention to provide a method and apparatus for carbon dioxide pellet blast cleaning that eliminates any potential problems of contamination by oils or other foreign materials.

It has been discovered that the foregoing objectives can be attained by a method and apparatus for blast cleaning the surface of an object by subjecting a portion of liquified carbon dioxide contained in a storage vessel to adiabatic expansion to provide a solid phase carbon dioxide and then compressing or extruding the solid phase carbon dioxide to form pellets. Another portion of the liquified carbon dioxide is vaporized to provide a volume of gaseous carbon dioxide at an above atmospheric pressure which pressurized gaseous carbon dioxide is used as a carrier and propellent to project the carbon dioxide pellets against the surface of the object to be cleaned.

DESCRIPTION OF THE PREFERRED EMBODIMENT

Figure 1:
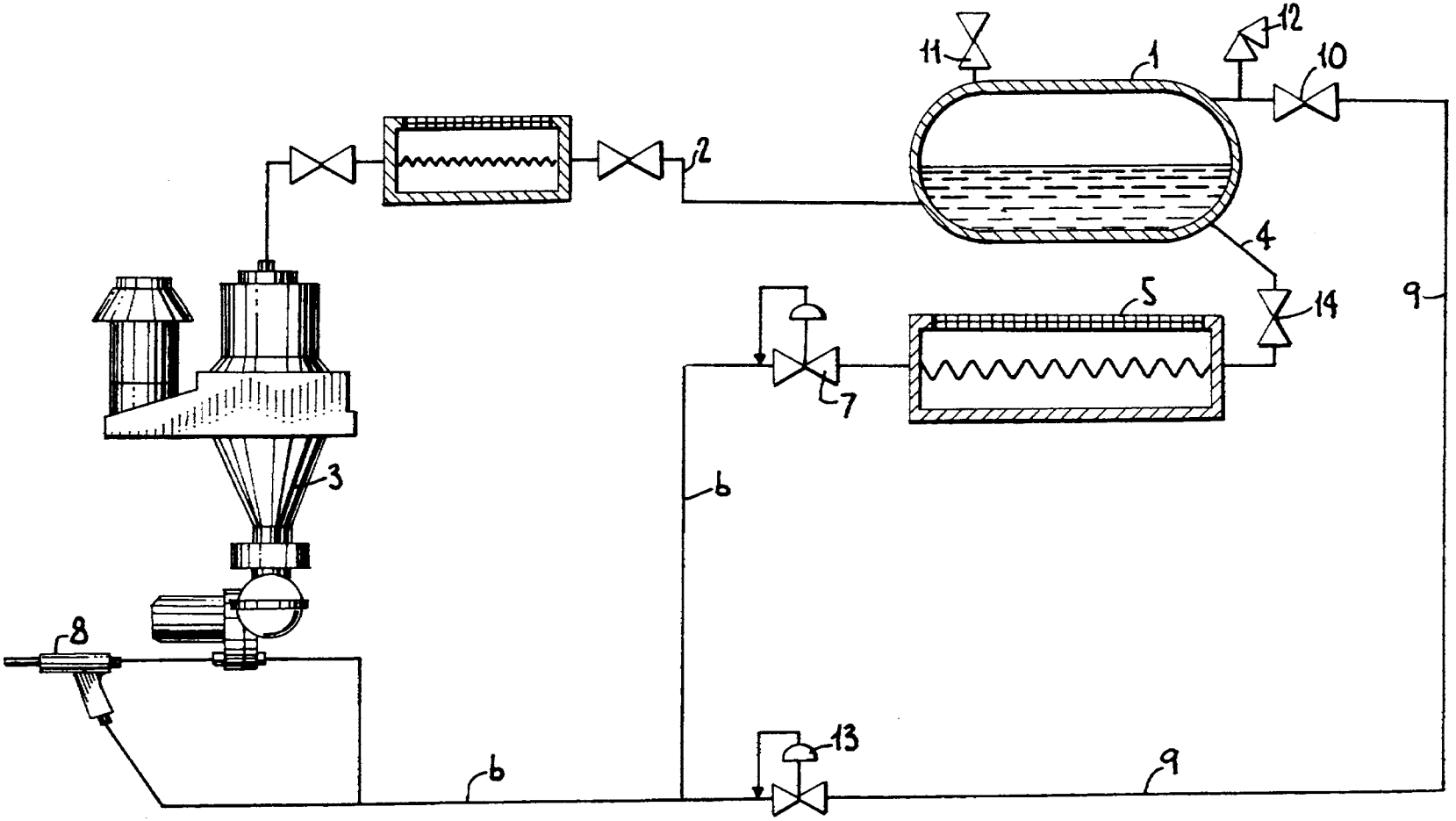
FIG. 1 is a schematic diagram of the method and apparatus used to practice this invention.

FIG. 1 illustrates a schematic diagram showing the method and apparatus used to practice a preferred embodiment of this invention. This embodiment is designed as a portable or mobile blast cleaning facility that can be easily transported to the work site but this invention is also adaptable to a permanent installation in a fabrication shop or the like. As shown in FIG. 1, a large pressurized storage vessel 1 contains a quantity of liquified carbon dioxide maintained about −18 degrees C. to keep the carbon dioxide in a liquid phase within the storage vessel 1. A liquid phase line 2, with suitable valves and pressure regulators, conveys a portion of the liquified carbon dioxide from the storage vessel 1 to a pelletizer unit 3 where the liquified carbon dioxide is adiabatically expanded to produce solid phase carbon dioxide snow which is then compressed or extruded into solid carbon dioxide pellets. The pelletizer unit 3 itself can be one of several commercially available designs, such as described in U.S. Pat. Nos. 4,617,064; 4,707,951; 4,727,687; 4,947,592 and 5,109,636.

A second line 4 connected to the liquid phase carbon dioxide storage vessel 1 by a valve 14 conveys another portion of the liquified carbon dioxide through a vaporizer 5 in which this portion of the liquified carbon dioxide is vaporized into gaseous carbon dioxide at an above atmospheric pressure. The vaporizer 5 is a commercially available cryogenic atmospheric vaporizer unit which may be fitted with heaters and fans to control its operation and output. Line 6, equipped with a pressure regulator 7 and safety valves (not shown) conveys the gaseous carbon dioxide produced in the vaporizer 5 to the blast cleaning gun 8 and a branch of line 6 to the discharge portion of the pelletizer unit 3 whereby the solid carbon dioxide pellets produced in the pelletizer unit 3 are entrained in the gaseous carbon dioxide from line 6 and propelled at high velocity against the surface of the object to be cleaned.

As illustrated in FIG. 1, this embodiment also utilizes as a propellent, the vaporized carbon dioxide that is generated in the storage vessel 1 as a result of the ambient atmosphere around the storage vessel 1. A liquified carbon dioxide storage vessel is normally equipped, and required by codes, to provide for the bleeding-off or discharge to the atmosphere of excess gaseous carbon dioxide generated within the storage vessel to prevent excessive pressure build-up within the storage vessel. The release of this excess pressurized gaseous carbon dioxide from within the vessel also serves to reduce the temperature of the interior of the storage vessel and thereby keep the carbon dioxide contained in the storage vessel in a liquid phase.

In this embodiment, the storage vessel 1 is equipped with both a manual valve 11 and an automatic safety bleed-off valve 12. The automatic safety bleed-off valve 12 is commonly set to open at about 350 psig. and release the excess gaseous carbon dioxide into the atmosphere until the temperature of the liquid carbon dioxide in the storage vessel 1 is back down to about −18 degrees C. and its equilibrium pressure is about 300 psig. at which point the automatic bleed-off safety valve 12 will close. This sequence will repeat itself each time the temperature of the atmosphere surrounding the storage vessel 1 causes the internal pressure within the storage vessel 1 to rise again to about 350 psig.

In this embodiment a line 9 is connected to a vapor phase bleed-off valve 10 adjusted to open at about 300 psig. Line 9, with suitable additional valves and a regulator 13, is attached to line 6, which connects the vaporizer 5 to the blast gun 8. As a result of this invention, one can capture and use as a propellent, all of the gaseous carbon dioxide that would normally be bled-off from the storage vessel 1 into the atmosphere and wasted.

This carbon dioxide gas, which would normally be lost to the atmosphere, is now able to be retained and used as the propellent for many short time cleaning applications since its pressure of about 300 psig. is normally in excess of the pressure needed as a propellent. When the pressure of the gas in line 9 drops sufficiently to reduce its effectiveness as a propellent, a valve 14 will open and will allow additional gas produced by the vaporizer 5 to supplement the bleed-off gas in line 6 going to the blast cleaning gun 8. A pressure regulator 7 in line 6 and a pressure regulator 13 in line 9 allow the operator to adjust the pressure of the propellent gas going to the blast cleaning gun 8 according to the blast cleaning operations. The pressure of the propellent gas in line 6 will typically be between 50 to 300 psig.

The vaporizer 5 may be equipped with heaters or fans to provide gaseous carbon dioxide in the volumes and pressures as may be needed. If necessary the system may also be equipped with a cryogenic pump and a higher pressure vaporizer 5 in the event one needs to obtain propellent pressures above 300 psig.

While I have described this invention by illustrating and describing the preferred embodiment of it, I have done this by way of example, and am not to be limited thereby as there are modifications and adaption that could be made within the teachings of this invention.

I claim:

1. A method for cleaning the surface of an object comprising:

(A) subjecting a portion of liquified carbon dioxide contained in a storage vessel to adiabatic expansion to produce a solid phase carbon dioxide, (B) compressing said solid phase carbon dioxide to form a plurality of pellets, (C) producing a first volume of gaseous carbon dioxide at above atmospheric pressure by passing a portion of the liquified carbon dioxide through a vaporizer external to said storage vessel, and producing a second volume of gaseous carbon dioxide at above atmospheric pressure by bleeding-off pressure within said storage vessel, and (D) using said first and second volumes of said gaseous carbon dioxide as a carrier and propellent to project said pellets against the surface of the object to be cleaned.

2. The method of claim 1 in which said volume of gaseous carbon dioxide is removed from said storage vessel to reduce the temperature of said liquified carbon dioxide contained within said storage vessel.

3. The method of claim 1 in which the pressure of the gaseous carbon dioxide is adjusted to a predetermined pressure used to propel said pellets against the surface of the object to be cleaned.

4. Apparatus for cleaning the surface of an object comprising:

(A) a storage vessel containing a quantity of liquified carbon dioxide, (B) a pelletizer unit adapted to produce solid carbon dioxide pellets from a portion of said liquified carbon dioxide, (C) a blast cleaning gun adapted to receive said solid carbon dioxide pellets, (D) means to vaporize with a vaporizer external to said storage vessel, a second portion of said liquified carbon dioxide to produce a first volume of gaseous carbon dioxide at above atmospheric pressure, and means to produce a second volume of gaseous carbon dioxide at above atmospheric pressure, comprising a bleed-off valve attached to said storage vessel for bleeding-off pressure within said storage vessel, and (E) conduit means adapted to convey said first and second volumes of said gaseous carbon dioxide to said blast cleaning gun as a carrier and propellent to project said pellets against the surface of the object to be cleaned.

5. The apparatus of claim 4 in which a pressure regulator is provided in said conduit means.

* * * * *